United States Patent [19]

Sherrill

[11] 4,240,173

[45] Dec. 23, 1980

[54] POOL VACUUM

[76] Inventor: John C. Sherrill, 547 W. Southern Hills Rd., Phoenix, Ariz. 85023

[21] Appl. No.: 57,211

[22] Filed: Jul. 13, 1979

[51] Int. Cl.[3] ..... E04H 3/20

[52] U.S. Cl. ..... 15/1.7; 15/409

[58] Field of Search ..... 15/1.7, 409

[56] References Cited

U.S. PATENT DOCUMENTS

| | | | |
|---|---|---|---|
| 1,078,512 | 11/1913 | Mills | 15/409 X |
| 1,172,450 | 2/1916 | Griffin | 15/409 X |
| 2,688,835 | 9/1954 | Rawson | 15/409 X |
| 3,301,606 | 1/1967 | Bruno | 15/409 X |
| 3,444,584 | 5/1969 | Cote | 15/409 X |

FOREIGN PATENT DOCUMENTS

| | | | |
|---|---|---|---|
| 221974 | 8/1968 | Sweden | 15/409 |
| 270231 | 11/1950 | Switzerland | 15/409 |
| 199338 | 6/1923 | United Kingdom | 15/1.7 |
| 1171159 | 11/1969 | United Kingdom | 15/409 |

*Primary Examiner*—Edward L. Roberts
*Attorney, Agent, or Firm*—LaValle D. Ptak

[57] ABSTRACT

A pool vacuum comprises an elongated pipe section having a flattened debris pickup end and a discharge end for discharging debris into a bag which is removably attached to the pipe section. Intermediate the ends of the elongated pipe section is a larger pipe section which is spaced from and sealed to the elongated pipe section to form a fluid discharge chamber surrounding the elongated pipe section. Apertures are formed between the chamber and the discharge end of the elongated pipe section to direct fluid applied under pressure to the chamber rearwardly through the elongated pipe section. This creates a partial vacuum for causing debris located near the pickup end of the elongated pipe section to be sucked up and directed into the bag whenever fluid under pressure is supplied to the chamber.

9 Claims, 8 Drawing Figures

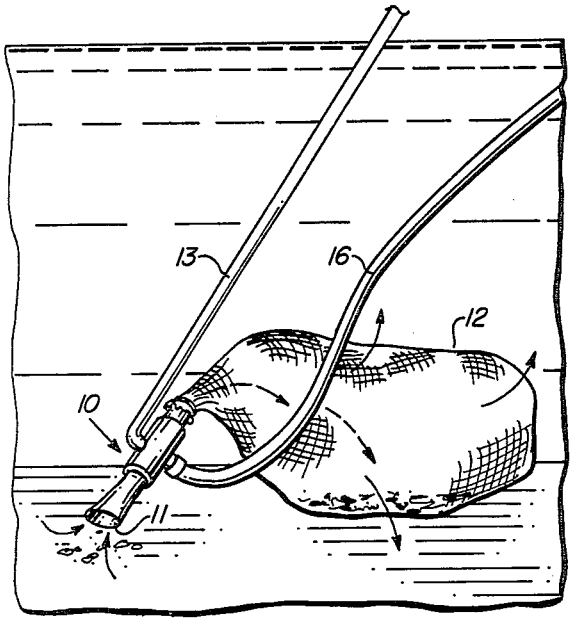
FIG. 1
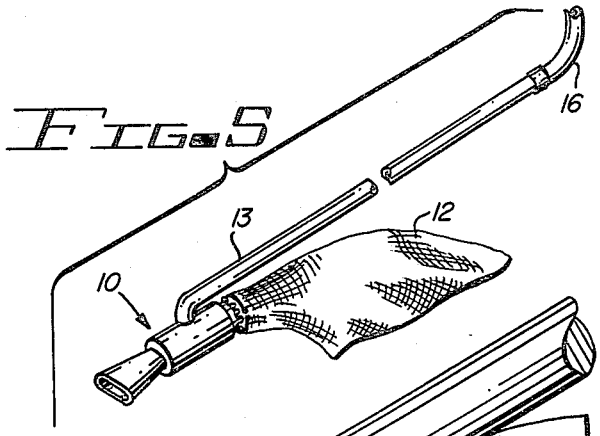
FIG. 5
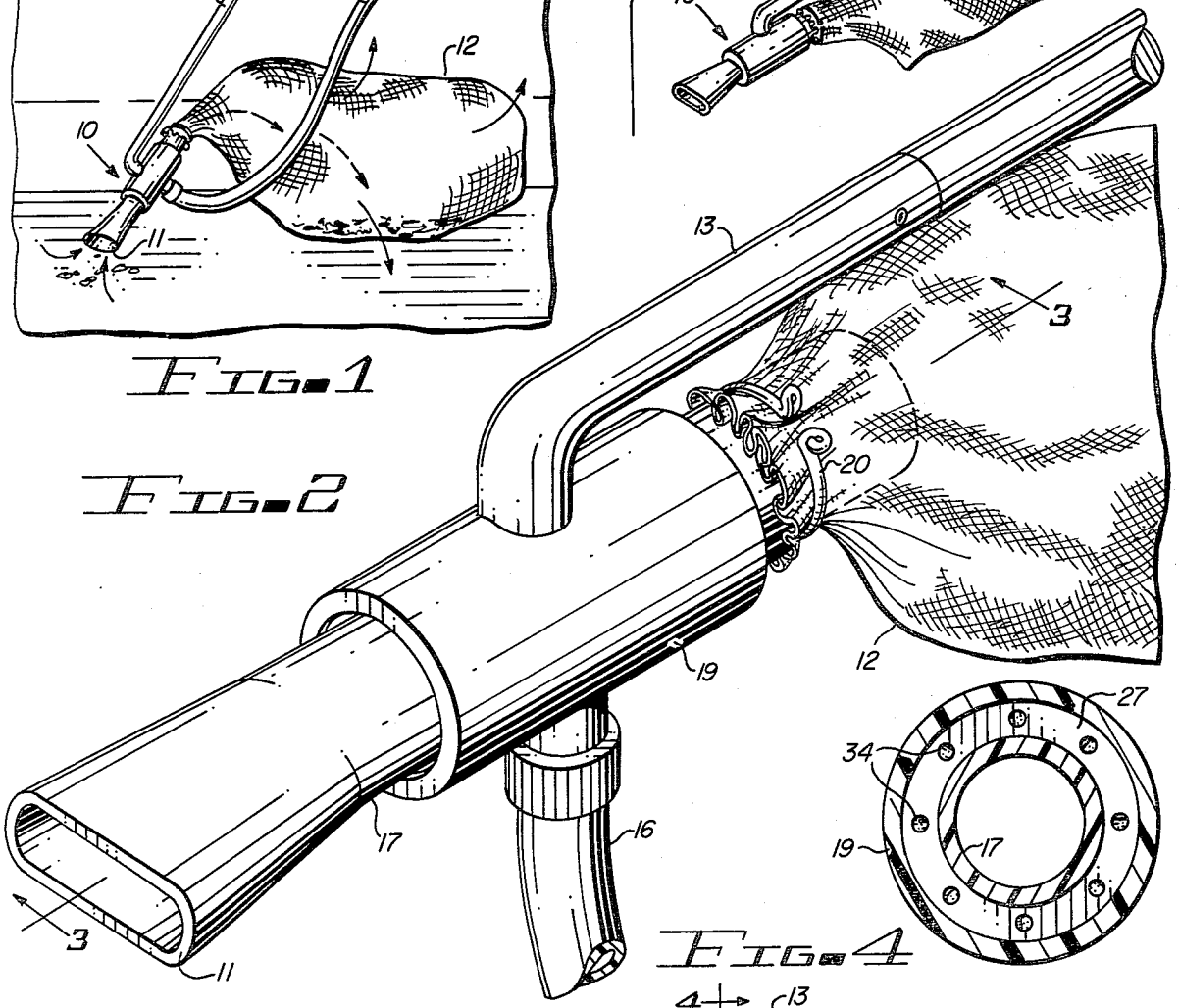
FIG. 2
FIG. 4
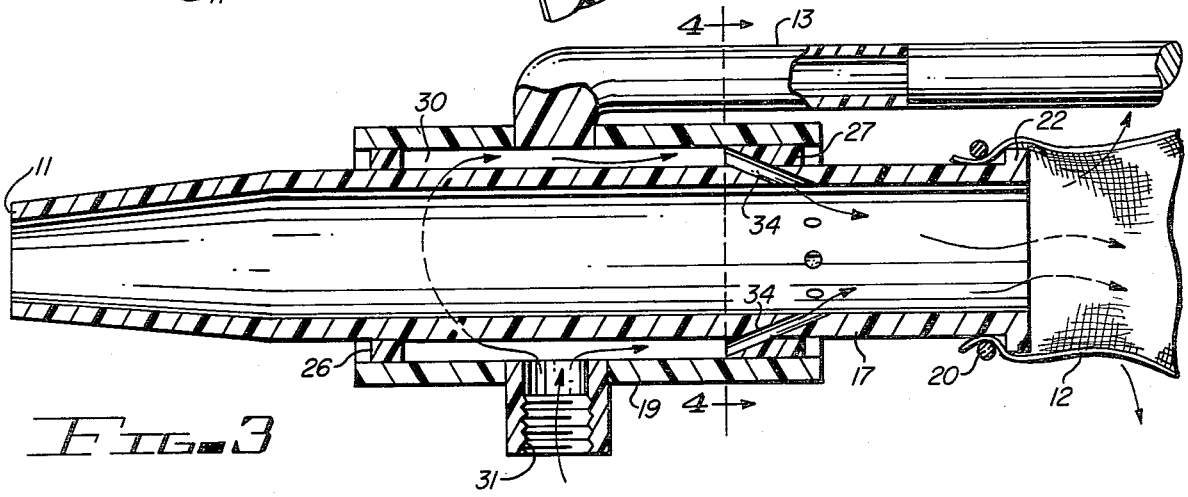
FIG. 3

POOL VACUUM

BACKGROUND OF THE INVENTION

A problem which arises in private and commercial swimming pool installations, fish ponds, decorative pools and fountains is the accumulation of debris, such as leaves and the like, on the pool bottom. In swimming pools, a leaf skimmer system generally manages to skim off and catch all such items of debris which float on the surface long enough to be pulled into the skimmer by the natural currents of the recirculating water in the pool. Even in such pools, however, debris often sinks to the bottom before it has an opportunity to be caught in the skimmer. In pools which do not have a skimmer apparatus in them, such as fish ponds and decorative pools, are blown in or dropped in debris ultimately sinks to the bottom of the pool.

Debris which accumulates on the bottom of a pool is unsightly. In addition, such debris also accelerates the formation and growth of algae; and as the debris decomposes, it tends to create a cloudy condition in the water and is generally undesirable. For swimming pool installations, pool vacuuming apparatus generally is removably connected to the water intake for the pool recirculating system to suck up the debris from the bottom of the pool and deliver it to the main pool filter from which it may be removed or backwashed. Even in pools which have this capability, however, the removal of debris from the bottom of the pool in this manner, while effective, usually necessitates the disassembly of part of the skimmer apparatus in order to connect the vacuum hose to the water return for the pool circulation system. In addition, there is a definite disadvantage of sucking all of the pool debris into the main filter section of the pool through the vacuuming system. Generally there is no other choice, and this is a commonly accepted practice.

For pools where there is no recirculating water supply, however, the use of a vacuuming system of the type described above is precluded. In such pools, debris on the bottom of the pool must be removed by means of skimmer nets dragged over the debris. At best, only a portion of the debris is caught by such a net as it is moved back and forth over the pool bottom.

In pools of all types, it is frequently necessary to add additional water to replace the water which is splashed out of the pool, or which evaporates from it. Pool vacuums which use the addition of water to the pool to effect their operation have been devised where water under pressure is supplied to the pool through nozzles directed to a debris pickup bag or the like to blow debris located on the bottom of the pool into the pickup bag. Such debris then subsequently is removed from the bag. Systems of this type serve an added useful purpose of simultaneously supplying needed water to the pool while functioning to pick up debris from the bottom of the pool.

Most of the systems of the type used in the past, however, have the water supply nozzles located near the mouth or entrance of the debris pickup pipe or chamber to blow the debris into the chamber. Two such devices are disclosed in the patents to Lombardi, U.S. Pat. No. 2,725,356 issued Nov. 29, 1955, and Pansini, U.S. Pat. No. 3,961,393 issued June 8, 1976. Both of these patents relate to underwater pool vacuum devices having a rather large vacuuming pipe which is supported on wheels carried close to the bottom of the pool. An upwardly extending water jet (or a plurality of water jets) is supplied with water under high pressure through a hose to force a stream of water creating a vacuum to discharge into a basket or other receptacle through the exit end of the vacuum pipe. Thus, leaves and other debris located underneath the bottom of the vacuum pipe are sucked upwardly and discharged into the basket carried at the top of the device. It is necessary to pass these devices over the debris which is to be sucked up and they are relatively complex, cumbersome structures. In addition, these devices are not suitable for shallow ponds, such as fish ponds, since considerable vertical depth is required underwater to accommodate the basket.

It is desirable to provide a pool vacuum device operating with water supplied under pressure which is of simple construction, light weight, and effective for use in removing debris from the bottom of a pool, and which does not have the disadvantages of the prior art devices and methods discussed above.

SUMMARY OF THE INVENTION

Accordingly, it is an object of this invention to provide an improved pool vacuum.

It is another object of this invention to provide an improved pool vacuum operated by fluid supplied to it under pressure.

It is an additional object of this invention to provide an improved pool vacuum which simultaneously supplies make-up water to the pool as it accomplishes its vacuuming function.

It is a further object of this invention to provide a pool vacuum operating with water supplied to it under pressure and which is of light weight and simple construction.

In accordance with a preferred embodiment of this invention, a pool vacuum comprises a primary hollow pipe section with a debris pickup end and a discharge end. A fluid discharge means is coupled with the pipe section for discharging fluid under pressure at the discharge end of the hollow pipe section to create a vacuum flow of fluid through the pipe section from the pickup end to the discharge end thereof. In more specific embodiments of the invention, the fluid discharge means comprises a second pipe section surrounding the first pipe and forming a hollow chamber between the interior surface of the second pipe section and the exterior surface of the hollow pipe section. Apertures are located between this chamber and the hollow pipe section for directing fluid supplied under pressure into the chamber from the chamber into the hollow pipe section to create a vacuum therein, so that debris located in the pool near the pickup end of the hollow pipe section is pulled through the hollow pipe section to be deposited into a debris catching receptacle attached to the discharge end of the hollow pipe section.

BRIEF DESCRIPTION OF THE DRAWINGS

FIG. 1 is a perspective view of a preferred embodiment of the invention showing its manner of use;

FIG. 2 is a detailed perspective view of a portion of the embodiment shown in FIG. 1;

FIG. 3 is a sectionalized view of the appartatus shown in FIG. 2 taken along the line 3—3.

FIG. 4 is a sectionalized view taken along the lines 4—4 of FIG. 3;

FIG. 5 shows an alternative embodiment of the apparatus shown in FIG. 1;

DETAILED DESCRIPTION

Figure 6:
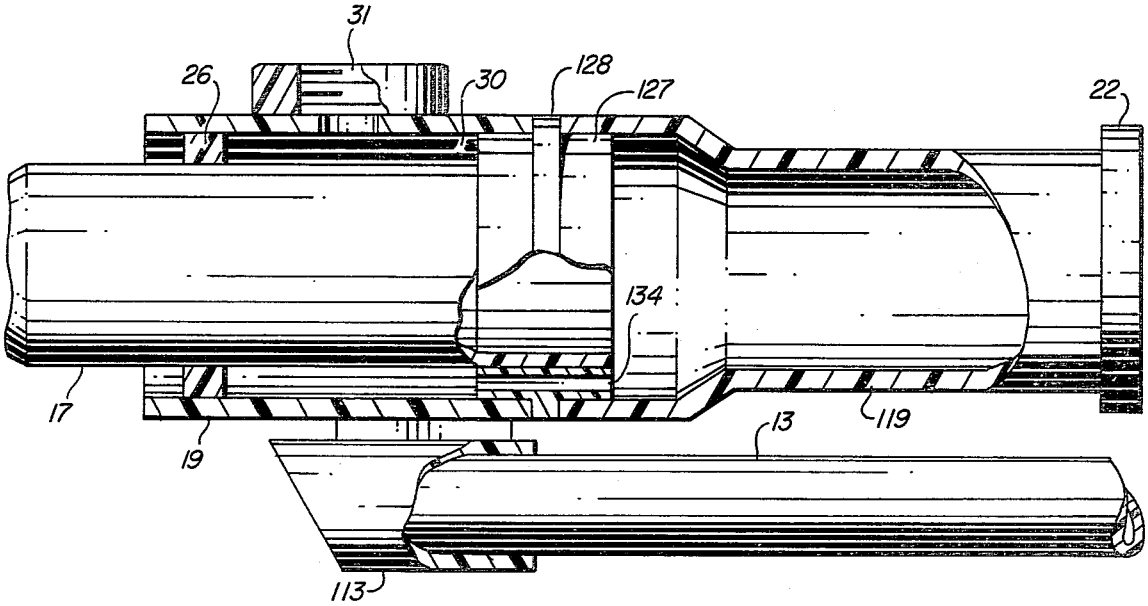
FIG. 6 is a sectionalized view of another modification of an embodiment which may be used in place of the one shown in FIGS. 2 and 3.

Reference now should be made to the drawings in which the same reference numbers are used throughout the different figures to designate the same or similar components. FIG. 1 illustrates a preferred embodiment of the invention as it is used to vacuum up leaves and other debris from the botom of a swimming pool or other type of pool. The vacuum device 10 has an inlet end 11 comprised of a flared section of a pipe, and the vacuum operates to suck water and pool bottom debris along with the water through the vacuum device 10 into a bag or basket 12. The mesh of the bag 12 is small enough to permit the water to pass through but it prevents the debris from passing back out into the pool. A handle 13 is attached to the vacuum device 10 and permits the operator to stand on the edge of the pool and direct the nozzle 11 to wherever debris is located. Water is supplied under pressure through a hose 16 into the vacuum device 10 to create the suction used to move the debris from the pool bottom into the bag 12.

FIG. 2 shows the vacuuming portion of the apparatus in FIG. 1 in greater detail. In particular, FIG. 2 shows the elongated or flared generally rectangularly shaped debris pickup nozzle 11, which typically is formed by heating and flattening the end of a section of circular polyethelene pipe or the like. An intermediate section of the vacuum 10 to the rear of the pickup end 11 is the circular pipe section 17 over which is placed another short section 19 of a pipe having an internal diameter greater than the external diameter of the section 17 to form a space between the two sections. This is shown most clearly in FIG. 3.

The pipe section 17 passes entirely through the pipe section 19, as shown in both FIGS. 2 and 3, at the discharge end to which the bag 12 is removably attached by means of a plastic or stainless steel spring clip 20. To prevent the pressure of the water flowing out of the discharge end of the pipe 17 into the bag 12 from pulling the bag 12 off of the pipe 17, a lip or ridge 22 is formed on the end of the pipe 17 against which the clip 20 clamps the open end of the bag 12. This is shown most clearly in FIG. 3.

The enlarged outer pipe 19 is uniformly spaced from the pipe 17 by a front spacer 26 and a rear spacer 27 in the form of washer-like rings made of the same polyethelene or ABS plastic material as the pipes 17 and 19. A water-tight seal is made between the spacer rings 26 and 27 and the two pipes 17 and 19 to form a water-tight pressure chamber 30 surrounding the pipe 17, as shown most clearly in FIG. 3. Water from the hose 16 is supplied through an inlet 31 under pressure and this water exits through rearwardly directed apertures or passageways 34 formed or drilled through the forward inside edge of the spacer 27 and the pipe 17 near the discharge end of the pipe 17. These apertures 34 are uniformly spaced about the circumference of the pipe 17 as shown most clearly in FIG. 4; and the angle at which they are directed is most clearly shown in FIG. 3.

When water is supplied under pressure through the inlet 31 into the chamber 30, this water exits at relatively high pressure and velocity through the apertures 34 and outwardly through the discharge end of the pipe 17 into the bag or net 12. When this occurs, a vacuum or partial vacuum is created at the inlet nozzle 11 of the vacuum device. When this nozzle is placed near debris on the bottom of the pool, that debris along with water from the pool moves as indicated by the arrows in FIG. 1 into the nozzle 11 and passes through the pipe 17 along with the high pressure water exiting from the apertures 34 into the bag 12. The water then exits from the bag 12, leaving the leaves and other debris picked up from the bottom of the pool in the bag.

As is apparent from an examination of FIG. 3 the handle 13 may be attached to the outer pipe 30 which forms the high pressure water chamber around the pipe 17 by inserting the end of the handle into an aperture formed in the pipe 30. This is a close fit, however, and the connection which is made is a water tight connection; so that no water which is supplied under pressure to the chamber 30 passes out or leaks out around the connection of the handle 13 to the outer pipe 19.

The entire apparatus which is shown in FIGS. 1 through 4 may be made of conventionally available plastic pipe of the types widely used in the plumbing industry. The assembly is a lightweight compact assembly which effectively operates to pick up a wide variety of debris from the bottom of swimming pools and the like. Because of its compact shape, the assembly also is ideally suited for use in shallow pools, such as fish ponds, having a depth of as little as six inches.

While the embodiment shown in FIGS. 1 through 4 uses an elongated rigid handle 13 and a separate connection for the hose 16 on the opposite side of the outer pipe 19, it is possible to use a hollow handle 13 to which a garden hose or other suitable water supply 16 is connected at its upper end to supply water into the pressure chamber 30 between the two pipes 17 and 19. Such an alternative embodiment is illustrated in FIG. 5. The operation of the device is the same as that which has been described above in conjunction with FIGS. 1 through 4 and, for some applications, may be preferred to the embodiment of FIGS. 1 through 4.

Figure 8:
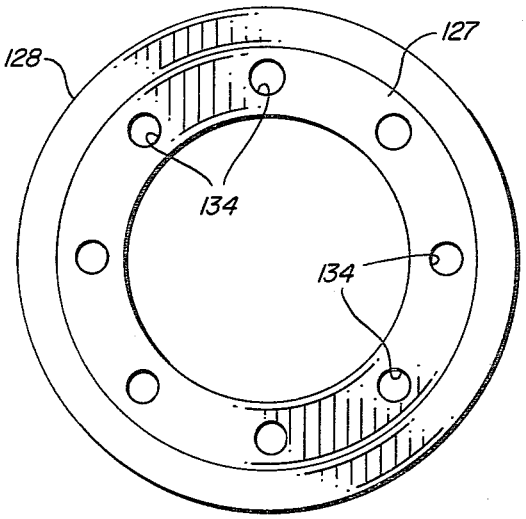
FIGS. 7 and 8 are side and end views of a portion of the apparatus shown in FIG. 6.
Figure 7:
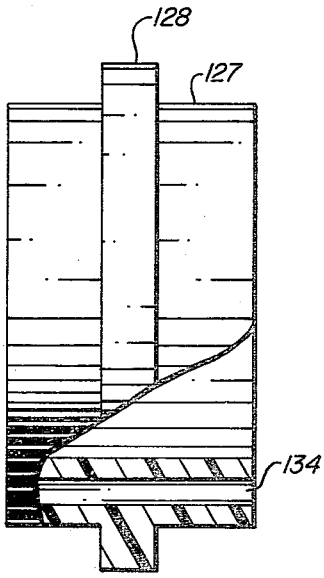

FIGS. 6, 7 and 8 illustrate another variation of the device which may be used in place of the one shown in cross section in FIGS. 3 and 4. In the embodiment of FIGS. 6, 7 and 8, the chamber 30 and its cooperation with the discharge end of the vacuum device 10 is constructed in a different manner from the embodiment shown in FIGS. 3 and 4.

The primary difference between the embodiment of FIGS. 6, 7 and 8 and the one in FIGS. 3 and 4 is in the substitution of a spacer 127 for the rear spacer 27 shown in FIG. 3. The pipe 17 then is bonded to the inside of the spacers 26 and 127 in the same manner described above in conjunction with FIG. 3; but the pipe 17 does not pass through the discharge end of the spacer 127, as is apparent by an examination of the sectional drawing of FIG. 6.

The chamber 30 of the device shown in FIG. 6 is formed by using a short section of larger diameter outer pipe 19 which is bonded to the external surfaces of the spacers 26 and 27 but the spacer 127 has a ridge 128 on it against which the right hand edge of the pipe section 19, as shown in FIG. 6, abuts to serve as a locating element for the parts shown in FIG. 6. Once all of the parts are bonded together, the water inlet connection 31 is the same for supplying water to the chamber 30 as is used in the embodiment of FIGS. 3 and 4. The spacer 127 however has holes formed directly through it parallel to the axis of the pipes 17 and 19 instead of diagonally formed through the pipe 17 as shown in FIG. 3.

An additional section 119 which has a tapered down cross sectional configuration, as shown most clearly in FIG. 6 then is abutted against the ridge 128 and bonded to the right hand portion of the spacer 127 to complete the construction. Water under pressure applied through the inlet 31 to the chamber 30 then exits directly parallel to the axis of the pipe 17 into the interior of the pipe section 119 to create the vacuuming action in the same manner described above in conjunction with the description of operation of the embodiment shown in FIGS. 2, 3 and 4. The bag 12 may be attached to the right hand end of the pipe secion 119 against the abutment 22 in the same manner described previously.

While the handle 13 may be attached to the pipe 19 of FIG. 6 in the same manner as shown in FIG. 3, it also is possible to mold a handle connecting section 113 to a pipe section 19 as an integral part thereof so that a handle 13 may be inserted into or threaded into the section 113 as indicated in FIG. 6. Once again it should be noted that there is no communication between the handle holding portion 113 and the water pressure chamber 30 which is formed around the pipe 17 by the space between the outer diameter of the pipe 17 and the inner diameter of the pipe 19 shown in FIG. 6.

Either of the two different embodiments which have described above function adequately to produce the desired simplified pool vacuuming action. Needed make up water is provided for the pool during the operation of the device; and after the debris has been vacuumed up, the entire assembly is lifted out of the pool. The bag 12 then is removed from the vacuuming device 10 and emptied. Whenever a bag 12 becomes worn or torn, it may be replaced since it is not permanently attached in any way to the remainder of the vacuuming apparatus 10 which has been shown and described.

Various modifications and changes will occur to those skilled in the art without departing from the scope of this invention. As a result, the embodiments which have been described above and which are shown in the drawings are to be considered illustrative only of the features of the invention claimed in the following claims.

I claim:

1. A pool vacuum including in combination:

a first intake hollow pipe section with a debris pick-up end and a discharge end wherein at least a portion of the discharge end thereof is cylindrical in cross section of a predetermined external diameter;

fluid discharge means comprising a second pipe section surrounding said discharge end of said first pipe section and spaced therefrom by first and second spacing means located substantially near the respective ends of said second pipe section to form a hollow chamber between the external surface of the discharge end of said first pipe section and the internal surface of the second pipe section, the second spacer located near the discharge end of said first pipe section having a plurality of apertures therethrough extending substantially parallel to the axis of said first pipe section;

a third pipe section having an inlet end and an outlet end with said inlet end having an internal diameter greater than the external diameter of said first pipe section and communicating with the apertures through said second spacer, said third pipe section being bonded to one of said spacer and said second pipe section to provide a fluid-tight bond therewith; and means for supplying fluid under pressure to the hollow chamber formed between said first pipe section and said second pipe section to cause the discharge of such fluid through the apertures in said second spacer into the inlet end of said third pipe section for discharge from the outlet end thereof.

2. The combination according to claim 1 further including coupling means for connection to a fluid supply hose for supplying fluid to said chamber under pressure; and a handle means connected to one of said pipe sections.

3. The combination according to claim 2 further including a debris net attached to the discharge end of said third hollow pipe section for enclosing a predetermined volume of space at said discharge end, said net constructed to permit the passage of fluid therethrough and to prevent the passage of debris therethrough.

4. The combination according to claim 1 wherein the pickup end of said first hollow pipe section is of a generally flattened rectangular configuration.

5. The combination according to claim 1 wherein said first hollow pipe section and said second pipe section are separated from one another at the discharge end of said hollow pipe section by said second spacer, and the inlet end of said third pipe section is bonded to said second spacer.

6. The combination according to claim 5 wherein said plurality of apertures are spaced uniformly through said second spacer circumferentially about the discharge end of said first hollow pipe section.

7. The combination according to claim 6 further including a coupling means for connection to a fluid supply hose for supplying fluid to said chamber under pressure; and a handle means connected to one of said hollow pipe sections.

8. The combination according to claim 7 further including a debris net attached to the discharge end of said third hollow pipe section for enclosing a predetermined volume of space at said discharge end, said net constructed to permit the passage of fluid therethrough and to prevent the passage of debris therethrough.

9. The combination according to claim 8 wherein the pickup end of said first hollow pipe section is of a generally flattened rectangular configuration.

* * * * *

REEXAMINATION CERTIFICATE (1186th)

United States Patent [19] [11] B1 4,240,173

Sherrill [45] Certificate Issued Jan. 16, 1990

[54] POOL VACUUM

[75] Inventor: John C. Sherrill, Phoenix, Ariz.

[73] Assignee: Innovative Products Corporation, Phoenix, Ariz.

Reexamination Request:
No. 90/001,644, Nov. 22, 1988

Reexamination Certificate for:

| | |
|---|---|
| Patent No.: | **4,240,173** |
| Issued: | **Dec. 23, 1980** |
| Appl. No.: | **57,211** |
| Filed: | **Jul. 13, 1979** |

[51] Int. Cl.[4] ..... E04H 3/20
[52] U.S. Cl. ..... 15/1.7; 15/409

[56] References Cited

U.S. PATENT DOCUMENTS

| | | |
|---|---|---|
| D. 177,633 | 5/1956 | Lombardi . |
| 307,855 | 11/1884 | Haughan . |
| 2,725,356 | 11/1955 | Lombardi . |
| 3,424,386 | 1/1969 | Maasberg . |
| 3,961,393 | 6/1976 | Pansini . |

FOREIGN PATENT DOCUMENTS

| | | |
|---|---|---|
| 23070 | 6/1972 | Australia . |
| 1171159 | 11/1916 | United Kingdom . |
| 102362 | 5/1956 | United Kingdom . |
| 1362522 | 8/1974 | United Kingdom . |

OTHER PUBLICATIONS

Newspaper Clipping on plastic jet vacuums, Jun. 1, 1958.
Poolmaster catalog, pp. 9 and 10 on J-12.
Poolmaster catalog on J-7.

*Primary Examiner*—Edward L. Roberts

[57] ABSTRACT

A pool vacuum comprises an elongated pipe section having a flattened debris pickup end and a discharge end for discharging debris into a bag which is removably attached to the pipe section. Intermediate the ends of the elongated pipe section is a larger pipe section which is spaced from and sealed to the elongated pipe section to form a fluid discharge chamber surrounding the elongated pipe section. Apertures are formed between the chamber and the discharge end of the elongated pipe section to direct fluid applied under pressure to the chamber rearwardly through the elongated pipe section. This creates a partial vacuum for causing debris located near the pickup end of the elongated pipe section to be sucked up and directed into the bag whenever fluid under pressure is supplied to the chamber.

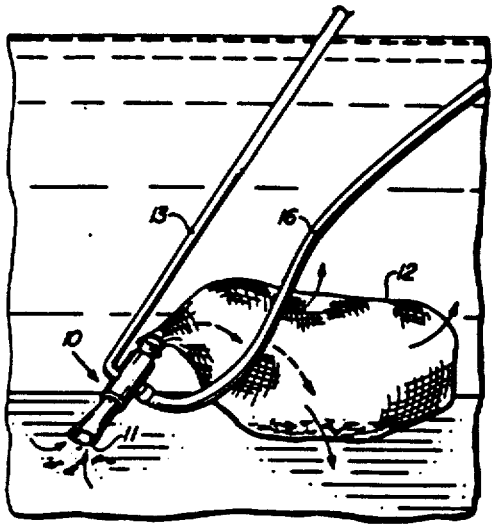

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–9 are cancelled.

* * * * *